US005511595A

United States Patent [19]

Stidham

[11] Patent Number: 5,511,595

[45] Date of Patent: Apr. 30, 1996

[54] FUNNEL DEVICE

[76] Inventor: William C. Stidham, 917 W. Florida, Chickasha, Okla. 73018

[21] Appl. No.: 349,537

[22] Filed: Dec. 5, 1994

[51] Int. Cl.[6] ..... B67C 11/00

[52] U.S. Cl. ..... 141/300; 141/297; 141/331; 141/339; 141/344

[58] Field of Search ..... 141/297–300, 141/331, 339–345

[56] References Cited

U.S. PATENT DOCUMENTS

| | | | |
|---|---|---|---|
| 8,928 | 5/1852 | Schneider | 141/298 |
| 49,738 | 9/1865 | Estabrook | 141/344 X |
| 57,347 | 8/1866 | Lochman | 141/344 |
| 59,590 | 11/1866 | Grattem | 141/344 X |
| 159,445 | 2/1875 | Pforr | 141/300 X |
| D. 205,236 | 7/1966 | Ilg | 141/331 X |
| 928,138 | 7/1909 | Lewis | 141/331 X |
| 1,405,266 | 1/1922 | Breiel | 141/331 |
| 1,651,963 | 12/1927 | Mooney | 141/297 |
| 2,526,784 | 10/1950 | Walker | 141/344 X |
| 3,912,638 | 10/1975 | Beaubien | 210/455 |
| 3,927,703 | 12/1975 | Beaubien | 141/333 |
| 4,130,147 | 12/1978 | Langlie et al. | 141/98 |
| 4,494,585 | 1/1985 | Waldecker | 141/98 |
| 5,100,620 | 3/1992 | Brenneman | 422/58 |
| 5,133,481 | 7/1992 | Mayfield | 222/466 |
| 5,186,358 | 2/1993 | McVay | 141/344 X |
| 5,228,488 | 7/1993 | Fletcher | 141/331 |

FOREIGN PATENT DOCUMENTS

| | | | |
|---|---|---|---|
| 0398676 | 6/1909 | France | 141/299 |
| 0420391 | 1/1911 | France | 141/299 |
| 1058171 | 3/1954 | France | 141/299 |
| 0003952 | of 1891 | United Kingdom | 141/340 |
| 0006944 | of 1906 | United Kingdom | 141/299 |
| 0012015 | of 1907 | United Kingdom | 141/300 |
| 0014482 | of 1909 | United Kingdom | 141/340 |
| 0389715 | 3/1933 | United Kingdom | 141/300 |

*Primary Examiner*—J. Casimer Jacyna
*Attorney, Agent, or Firm*—Craig W. Roddy

[57] ABSTRACT

A device for funneling liquid, wherein the device includes a funnel portion for receiving liquid, a vented tube-like handle for preventing liquid backup in the funnel portion and an outlet spout with an end and cooperative side opening for delivering liquid therefrom. A stopper, which has a ruled shaft for measuring liquid, is provided for controlling and stopping the flow of liquid from the device. In addition, an extension and outlet adapter are provided to accommodate various receiving containers.

21 Claims, 4 Drawing Sheets

FUNNEL DEVICE

BACKGROUND

The present invention relates generally to a device for funneling liquids, and more particularly, to a funnel having in combination therewith a tube-like handle, side kick outlet spout, outlet adapter and stopper for producing a quick, even and controlled flow of liquid therefrom.

Funnels are commonly known and used to prevent spilling in pouring liquids into containers with small openings. A conventional funnel includes a small tapering tube with a wide, cone-shaped mouth; however, this common design often causes liquid to bottleneck and backup therein. Additionally, known funnels lack an effective means for controlling and stopping the flow of liquid therefrom.

In view of the forgoing aspects, traditional funnels are undesirable for many reasons. Specifically, when liquid backs up in the funnel it causes more liquid to be poured into the funnel than can be held in the receiving container. As a result, pollutants such as oil, antifreeze, transmission fluid etc. overflow from the receiving container and spill onto the soil. This undesired spillage produces environmental contamination.

The present embodiment of the invention eliminates many undesired problems by providing a funnel having a means for preventing liquid backup therein and a means for controlling or stopping the flow of liquid therefrom.

There is a need for a simple, economical and effective funnel for liquids; nevertheless, until now, no device has been developed. For the foregoing reasons, there is a need for a funnel having a tube-like handle, side kick outlet spout, outlet adapter and stopper for producing a quick, even and controlled flow of liquid therefrom.

SUMMARY

The preferred embodiment of the invention satisfies the above needs and is directed to a device which provides a simple, economical and effective means for funneling liquid.

The present version of the invention comprises a hollow truncated conical funnel portion for receiving liquid and a tube-like handle in communication therewith, wherein the handle contains a vent. The funnel portion is integral with and discharges into a specifically shaped side kick outlet spout for delivering liquid therefrom. A screen is received inside the funnel portion to strain the liquid poured therein as well as to prevent the liquid from splattering and bubbling. Further, a lid is provided for enclosing the funnel portion during storage.

Alternatively, an extension is threadably coupled with the outlet spout for funneling liquid to a distant point. In addition, an outlet adapter may be threadably received on either the outlet spout or extension for modifying the size thereof, wherein the device is adaptable for pouring liquid into various sized container openings.

As such, it is a first object of the embodiment of the invention to provide a device which prevents environmental contamination by eliminating the spillage of pollutants.

It is a further object of the embodiment of the invention to provide a device having a tube-like handle in communication with the funnel portion, wherein the handle reduces liquid backup in the funnel portion to provide a quick and even flow of the liquid from the device.

It is a further object of the embodiment of the invention to provide a device having a specifically shaped side kick outlet spout to prevent obstruction by foreign objects and to enhance the flow of liquid therefrom.

It is a further object of the embodiment of the invention to provide a device having a stopper for controlling and stopping the flow of liquid therefrom.

It is a further object of the embodiment of the invention to provide a device having a means for measuring the quantity of liquid received into the funnel portion while plugged.

It is a further object of the embodiment of the invention to provide a device having an extension for delivering liquid to a distant point.

It is a further object of the embodiment of the invention to provide a device having an outlet adapter for modifying the size of the outlet spout or extension, wherein the device is able to pour liquid into various sized container openings.

It is a further object of the embodiment of the invention to provide a device having a removable lid for enclosing the funnel portion, wherein the device is used as a storage container for the detachable components thereof.

It is a final object of the embodiment of the invention to provide a device which provides a simple, economical and effective means of funneling liquid.

BRIEF DESCRIPTION OF THE DRAWINGS

These and other features, aspects, and advantages of the present invention will become better understood with regard to the following description, appended claims, and accompanying drawings where:

DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications, and equivalents, which may be included within the spirit and scope of the invention as defined by the appended claims.

Figure 1:
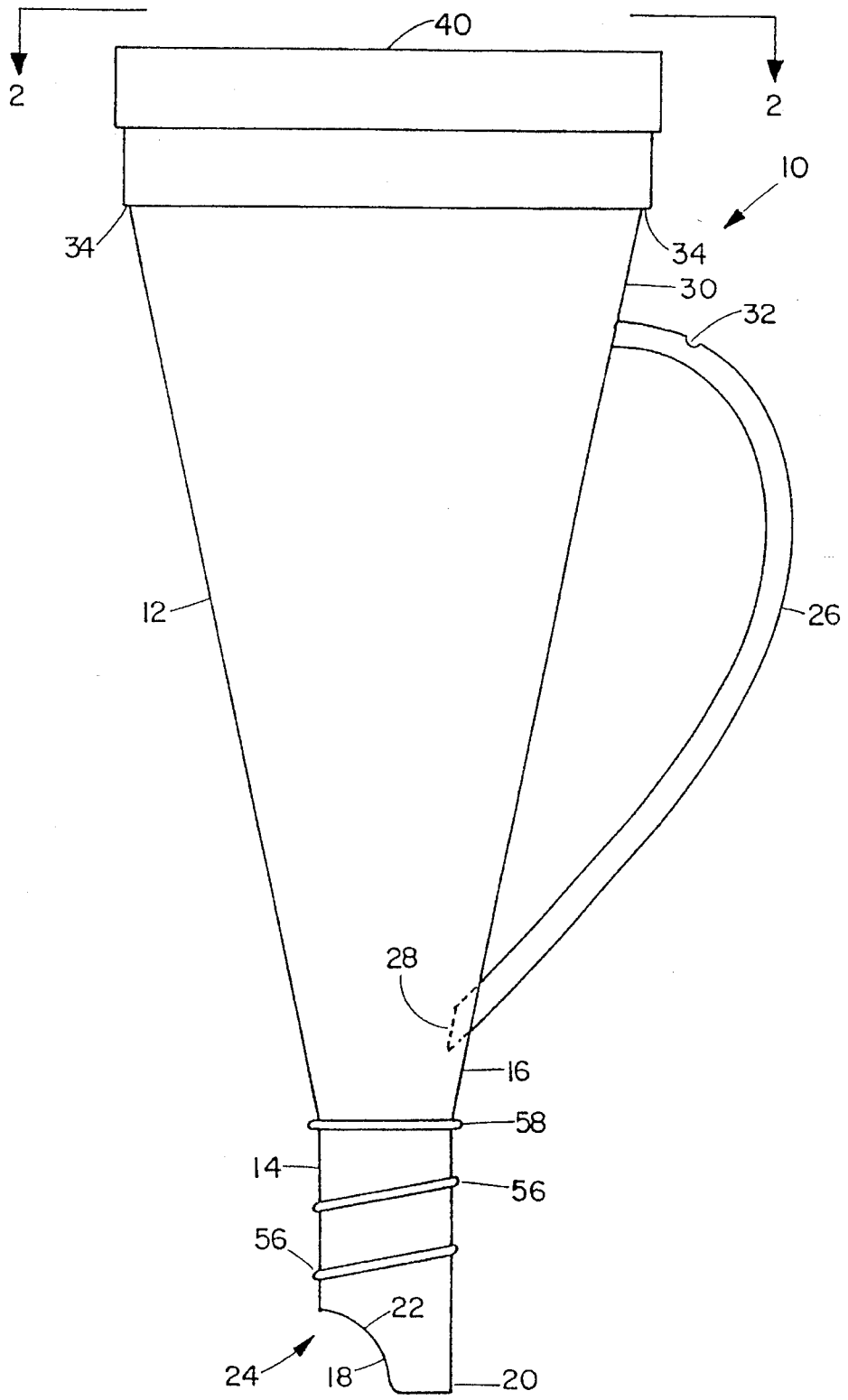
FIG. 1 is a front elevation view of the funnel device constructed in accordance with the present embodiment of the invention.
Figure 2:
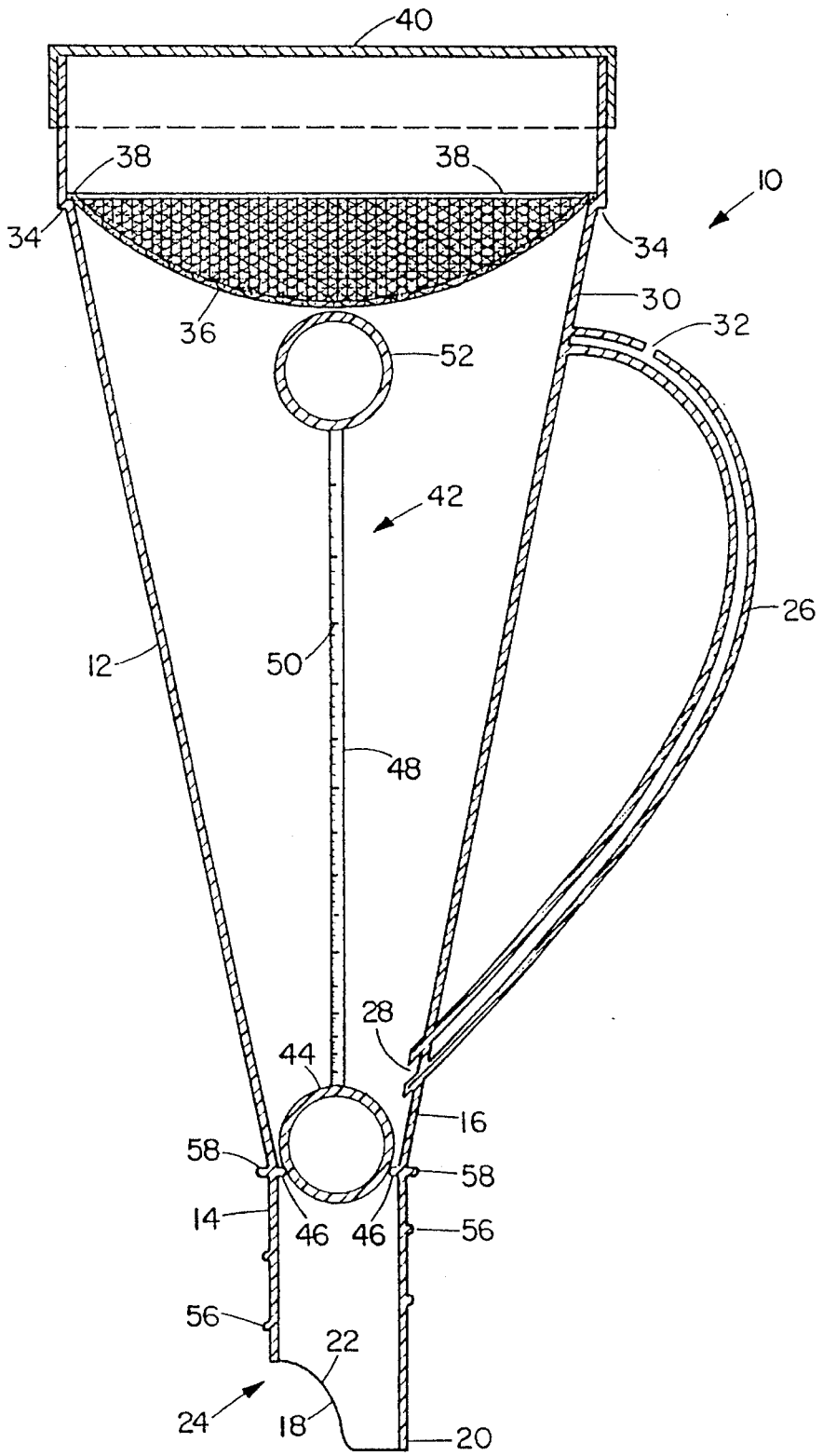
FIG. 2 is a section view taken along line 2—2 of FIG. 1, showing the stopper and screen therein.

As best illustrated in FIGS. 1 and 2, the present embodiment of the invention relates to a funnel device 10, which is useful to prevent spilling of liquid being poured into containers having various sized openings. The device 10 is preferably made of plastic, such as polyethylene or the like, except as otherwise noted herein.

Figure 3:
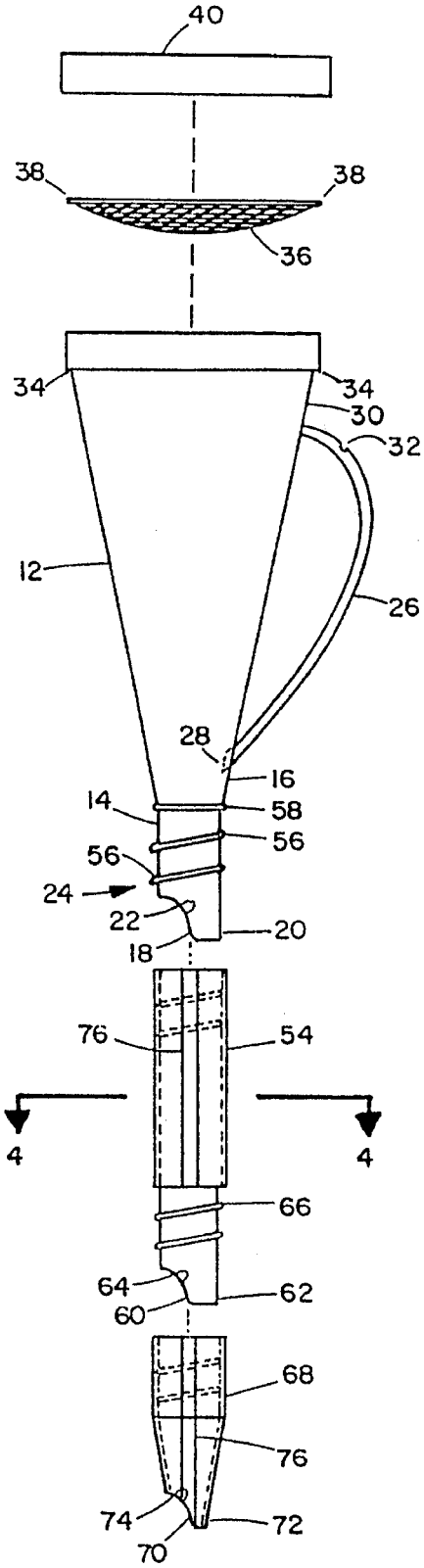
FIG. 3 is an exploded view of an alternative embodiment of the invention which includes the extension and adapter.

As shown in FIGS. 1, 2 and 3, the preferred device 10 includes a hollow truncated conical funnel portion 12 for receiving liquid, wherein the funnel portion 12 is integral with and discharges into a pipe-like outlet spout 14 on a lower end 16 thereof. The funnel portion 12 is in alignment with the longitudinal axis of the outlet spout 14.

The outlet spout 14 has a specifically shaped discharge opening 18 generally defined in an end 20 thereof. The discharge opening 18 extends into an adjacent side portion 22 of the outlet spout 14, whereby the opening 18 allows liquid to flow from the end 20 and cooperative side portion 22. Hence, the outlet spout 14 and discharge opening 18 are collectively referred to herein as a side kick outlet spout 24. Furthermore, because the discharge opening 18 delivers liquid from the end 20 and side 22 portion of the outlet spout 14, foreign objects, which normally obstruct a flat discharge opening found in known funnels, do not impede the flow of liquid from the opening 18.

As seen in FIGS. 1 and 2, a preferred means for preventing liquid backup in the funnel portion 12 includes a hollow tube-like handle 26 which is received into the hollow funnel portion 12. The handle 26 segment received in the funnel portion 12 is slightly angled towards and generally adjacent the outlet spout 14. Hence, the hollow funnel portion 12 communicates with the hollow portion of the handle 26.

A handle opening 28, which is located inside the funnel portion 12 to provide communication with the hollow portion of the handle 26, generally lies in a plane parallel the longitudinal axis of the outlet spout 14. The handle 26 preferably extends and is attached to an upper end 30 of the funnel portion 12, thereby forming a suitable design for grasping and holding the device 10 therewith. Obviously, the means for preventing liquid backup may be comprised of any tube, conduit or the like which communicates with the funnel portion 12 and allows liquid to move therebetween. While the preferred means for preventing liquid backup is designed for use as a handle 26, numerous other configurations are suitable for preventing liquid backup.

The handle 26 has a vent 32 located generally near the upper end 30 of the funnel portion 12. The vent 32 allows liquid to freely move within the handle 26 and is located such that liquid cannot exit therethrough. In addition, the vent 32 allows the hollow portion of the handle 26 to be cleaned using a pipe cleaner or other suitable cleaning article which can be inserted through the vent 32 and received through the handle 26.

The tube-like handle 26 prevents liquid from bottlenecking in the lower end 16 of the funnel portion 12 by providing an undefined area adjacent the outlet spout 14. Consequently, liquid moves into the handle 26 thereby minimizing liquid pressure near the outlet spout 14 and allowing liquid to quickly and evenly flow from the device 10.

As shown in FIG. 2, defined within the funnel portion 12 is a lip 34 for accepting and holding a screen 36, wherein the screen 36 has a rim 38 therearound for resting on the lip 34. The screen 36 is removable from the funnel portion 12 and is preferably used when necessary for straining the liquid being poured therein. Also, the screen 36 is useful for reducing aeration and spattering of the liquid being poured into the funnel portion 12. The screen 36 is preferably constructed of stainless steel wire and has a sufficient mesh dimension for allowing liquid to flow therethrough. Obviously, different mesh sizes may be required for various liquids or applications.

The upper end 30 of the funnel portion 12 preferably extends beyond the lip 34 to couple with a removable lid 40, see FIGS. 1, 2 and 3. The lid 40 encloses the funnel portion 12 to form a container for storing detachable components of the device 10 therein. Furthermore, the lid 40 preferably includes a known securing means (not shown), such as a threaded coupling or lip, for securely combining the lid 40 with the funnel portion 12.

As illustrated in FIG. 2, a stopper 42 is provided for controlling and stopping the flow of liquid from the funnel portion 12. The stopper 42 includes a sphere-shaped plug 44 which is preferably hollow therein. A circular inner seal 46 is located within the device 10, generally where the funnel portion 12 attaches to the outlet spout 14; thus, liquid flows through the interior opening defined by the seal 46. The plug 44 has a greater diameter than the interior opening whereby the plug 44 mates with the interior opening of the seal 46 to control or stop the flow of liquid therethrough. Furthermore, the preferred funnel portion 12 contains sufficient area for allowing the plug 44 to pass by the handle 26 extended therein.

A shaft 48 is attached to the plug 44 and includes ruled markings 50 thereon for measuring the amount of liquid received in the device 10 while plugged. A grip ring 52 or the like is attached to the shaft 48 opposite the plug, whereby a person can grasp the ring 52 to control the plug 44. Therefore, it can be seen that with the screen 36 removed from the funnel portion 12, a person can use the stopper 42 to control and stop the flow of liquid from the device 10. Additionally, the person can use the stopper 42 to plug the funnel portion 12 and measure the amount of liquid to be funneled, thereby eliminating the possibility of overfilling a receiving container having a known capacity.

As shown in FIG. 3, a tube-like extension 54 may be coupled with the outlet spout 14 for funneling liquid to a distant point. Preferably, the extension 54 is clear to prevent unwanted spillage by allowing the user to visually determine when all fluids have been delivered therefrom.

The outlet spout 14 is threaded 56 for coupling with the extension 54. Further, the outlet spout 14 is received into the extension 54 until the extension 54 abuts an outer seal 58 on the exterior of the device 10. The outer seal 58 is located where the funnel portion 12 attaches to the outlet spout 14; thus, a leakproof seal is provided between the outlet spout 14 and extension 54.

Preferably, the extension 54 has a specifically shaped discharge opening 60 generally defined in an end 62 thereof. The discharge opening 60 extends into an adjacent side portion 64 of the extension 54, whereby the opening 60 allows liquid to flow from the end 62 and cooperative side portion 64. Because the discharge opening 60 delivers liquid from the end 62 and side 64 portion of the extension 54, foreign objects, which normally obstruct a flat discharge opening found in known funnels, do not impede the flow of liquid from the opening 60. Also, the liquid discharging end of the extension 54 is threaded 66 to receive an outlet adapter 68, see FIG. 3.

For accommodating various sized container openings, the outlet adapter 68 is threaded for removably coupling with either the outlet spout 14 or the extension 54. When the adapter 68 is received on the outlet spout 14 it fits against the outer seal 58 to provide a leakproof connection. Further, when the adapter 68 is attached to the extension 54, the adapter 68 and extension 54 fit flush together to provide a leakproof attachment therebetween.

Preferably, outlet adapters 68 of various tapering dimensions are provided because receptacles often have various sized openings; wherefore, the device 10 is adaptable for use with numerous containers. Furthermore, the outlet adapter 68 has a specifically shaped discharge opening 70 generally defined in an end 72 thereof. The discharge opening 70 extends into an adjacent side portion 74 of the outlet adapter 68, whereby the opening 70 allows liquid to flow from the end 72 and cooperative side portion 74. Because the discharge opening 70 delivers liquid from the end 72 and side 74 portion of the adapter 68, foreign objects, which normally obstruct a flat discharge opening found in known funnels, do not impede the flow of liquid from the opening 70.

In an alternative embodiment (not shown), the extension 54 includes a clear, flexible hose and threaded coupling means for coupling the hose with the outlet spout 14. The preferred hose diameter is sufficient for pouring liquids into a transmission filler, wherein the flexible hose provides easy access thereto. The hose has a discharge opening generally defined in an end and cooperative side portion thereof. Furthermore, the clear hose prevents unwanted spillage by allowing the user to visually determine when all fluids have been delivered therefrom.

Figure 4:
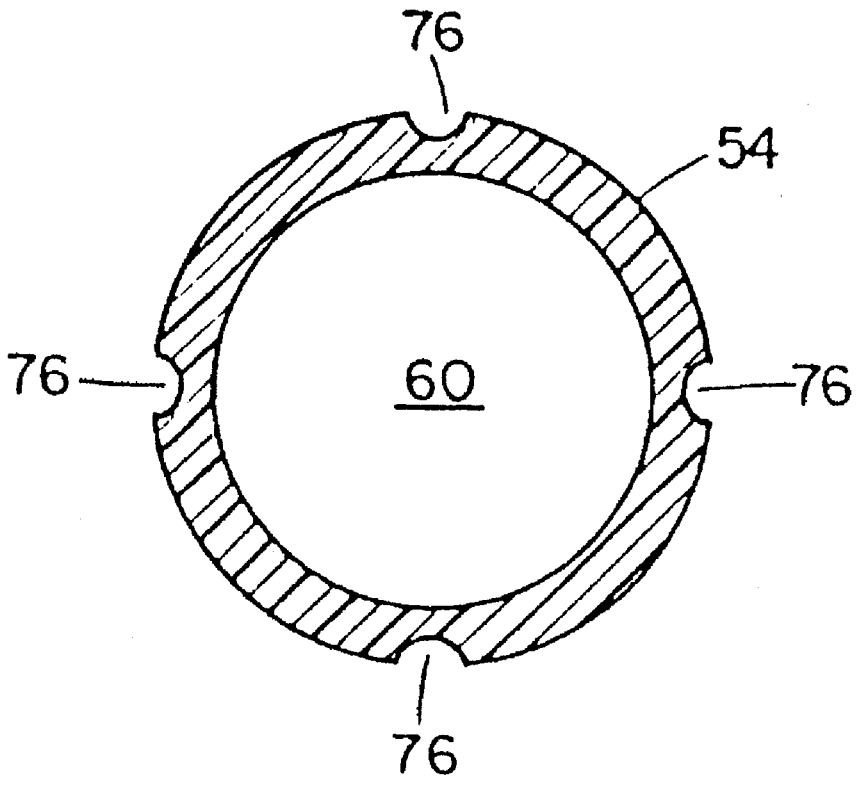
FIG. 4 is a section view taken along line 4—4 of FIG. 3, showing the grooves.

As illustrated in FIGS. 3 and 4, the extension 54 and adapter 68 each have exterior grooves 76, which are generally defined in alignment with their longitudinal axis. The grooves 76 provide a venting means for containers receiving funneled liquids therein, whereby air freely escapes from the container via the grooves 76. Also, the grooves 76 provide a gripping means for threadably coupling or uncoupling the extension 54 or adapter 68.

The previously described version of the invention has many advantages, including a simple and economic way of funneling liquid, wherein the liquid is prevented from backing up in the funnel portion 12. Another advantage of the present invention includes having a side kick outlet spout 24 for enhancing the flow of liquid from the device 10. Yet, another advantage of the present invention includes having a stopper 42 to control and stop the flow of liquid from the device 10.

The foregoing descriptions of specific embodiments of the present invention have been presented for purposes of illustration and description. They are not intended to be exhaustive or to limit the invention to the precise forms disclosed and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A device for funneling liquid, comprising:

a hollow funnel portion having a conical side wall for receiving the liquid;

an outlet spout for delivering the liquid from said funnel portion;

means for reducing backup of the liquid in said funnel portion wherein said means for reducing backup is in communication with said funnel portion;

wherein the liquid received in said funnel portion is allowed to move in and out of said means for reducing backup;

wherein said means for reducing backup includes a tube having an opening, said tube extends from outside said funnel portion through said side wall thereof and into said hollow funnel portion; and wherein said tube is extended into said hollow funnel portion at a location which is generally adjacent said outlet spout.

2. The device of claim 1, wherein said funnel portion is a truncated conical configuration.

3. The device of claim 1, wherein said opening allows liquid movement between said funnel portion and said tube.

4. The device of claim 1, wherein said opening is positioned on an end of said tube which is extended into said funnel portion.

5. A device for funneling liquid, comprising:

a hollow funnel portion having a conical side wall for receiving the liquid;

an outlet spout for delivering the liquid from said funnel portion;

means for reducing backup of the liquid in said funnel portion wherein said means for reducing backup is in communication with said funnel portion;

wherein the liquid received in said funnel portion is allowed to move in and out of said means for reducing backup;

wherein said means for reducing backup includes a tube having an opening, said tube extends from outside said funnel portion through said side wall thereof and into said hollow funnel portion;

wherein said tube is extended into said hollow funnel portion at a location which is generally adjacent said outlet spout; and wherein said tube is angularly received through said side wall of said funnel portion.

6. The device of claim 5, wherein said funnel portion is a truncated conical configuration.

7. The device of claim 5, wherein said opening allows liquid movement between said funnel portion and said tube.

8. The device of claim 5, wherein said opening is positioned on an end of said tube which is extended into said funnel portion.

9. The device of claim 5, wherein said tube angularly extends from said side wall toward said outlet spout.

10. The device of claim 5, further comprising means for controlling flow of the liquid from the device.

11. The device of claim 10, wherein said means for controlling flow includes a substantially round, spherically shaped stopper.

12. A device for funneling liquid, comprising:

a hollow funnel portion having a conical side wall for receiving the liquid;

an outlet spout for delivering the liquid from said funnel portion;

means for reducing backup of the liquid in said funnel portion wherein said means for reducing backup is in communication with said funnel portion;

wherein the liquid received in said funnel portion is allowed to move in and out of said means for reducing backup;

wherein said means for reducing backup includes a tube having an opening, said tube extends from outside said funnel portion through said side wall thereof and into said hollow funnel portion;

wherein said tube is extended into said hollow funnel portion at a location which is generally adjacent said outlet spout; and wherein said tube includes a vent.

13. The device of claim 12, wherein said funnel portion is a truncated conical configuration.

14. The device of claim 12, wherein said opening allows liquid movement between said funnel portion and said tube.

15. The device of claim 12, wherein said opening is positioned on an end of said tube which is extended into said funnel portion.

16. The device of claim 12, wherein said vent is located outside said funnel portion.

17. The device of claim 12, further comprising means for controlling flow of the liquid from the device.

18. The device of claim 17, wherein said means for controlling flow includes a substantially round, spherically shaped stopper.

19. A device for funneling liquid, comprising:

a hollow funnel portion having a conical side wall for receiving the liquid;

an outlet spout for delivering the liquid from said funnel portion;

means for reducing backup of the liquid in said funnel portion wherein said means for reducing backup is in communication with said funnel portion;

wherein the liquid received in said funnel portion is allowed to move in and out of said means for reducing backup;

wherein said means for reducing backup includes a tube having an opening, said tube extends from outside said funnel portion through said side wall thereof and into said hollow funnel portion;

wherein said tube is extended into said hollow funnel portion at a location which is generally adjacent said outlet spout; and means for controlling flow of the liquid from the device.

20. The device of claim 19, wherein said funnel portion is a truncated conical configuration.

21. The device of claim 19, wherein said means for controlling flow includes a substantially round, spherically shaped stopper.

* * * * *